9/4/84 XR 4,469,920

United States Patent [19]

Murphy

[11] Patent Number: 4,469,920

[45] Date of Patent: Sep. 4, 1984

[54] PIEZOELECTRIC FILM DEVICE FOR CONVERSION BETWEEN DIGITAL ELECTRIC SIGNALS AND ANALOG ACOUSTIC SIGNALS

[75] Inventor: Preston V. Murphy, Geneva, Switzerland

[73] Assignee: Lectret S.A., Geneva, Switzerland

[21] Appl. No.: 461,146

[22] Filed: Jan. 26, 1983

[30] Foreign Application Priority Data

Feb. 9, 1982 [FR] France ..... 82 02531

[51] Int. Cl.[3] ..... H04R 17/00

[52] U.S. Cl. ..... 179/110 A; 310/324; 310/800

[58] Field of Search ..... 179/110 A; 310/800, 310/322, 324, 366

[56] References Cited

U.S. PATENT DOCUMENTS

| | | | |
|---|---|---|---|
| 3,792,204 | 2/1974 | Murayama et al. | 179/110 A |
| 3,832,580 | 8/1974 | Yamamura et al. | 179/110 A |
| 4,295,010 | 10/1981 | Murphy | 179/110 A |

*Primary Examiner*—Gene Z. Rubinson
*Assistant Examiner*—Danita R. Byrd

[57] ABSTRACT

A piezoelectric film transducer useful in directly converting a digital signal into an acoustic analog signal; metallized film zones have different areas and are electrically insulated from each other; by selectively exciting different zones or groups of zones with the digital signal, different amplitudes result in the acoustic signal, depending on the area of the particular zone or the combined area of the group of zones.

2 Claims, 1 Drawing Figure

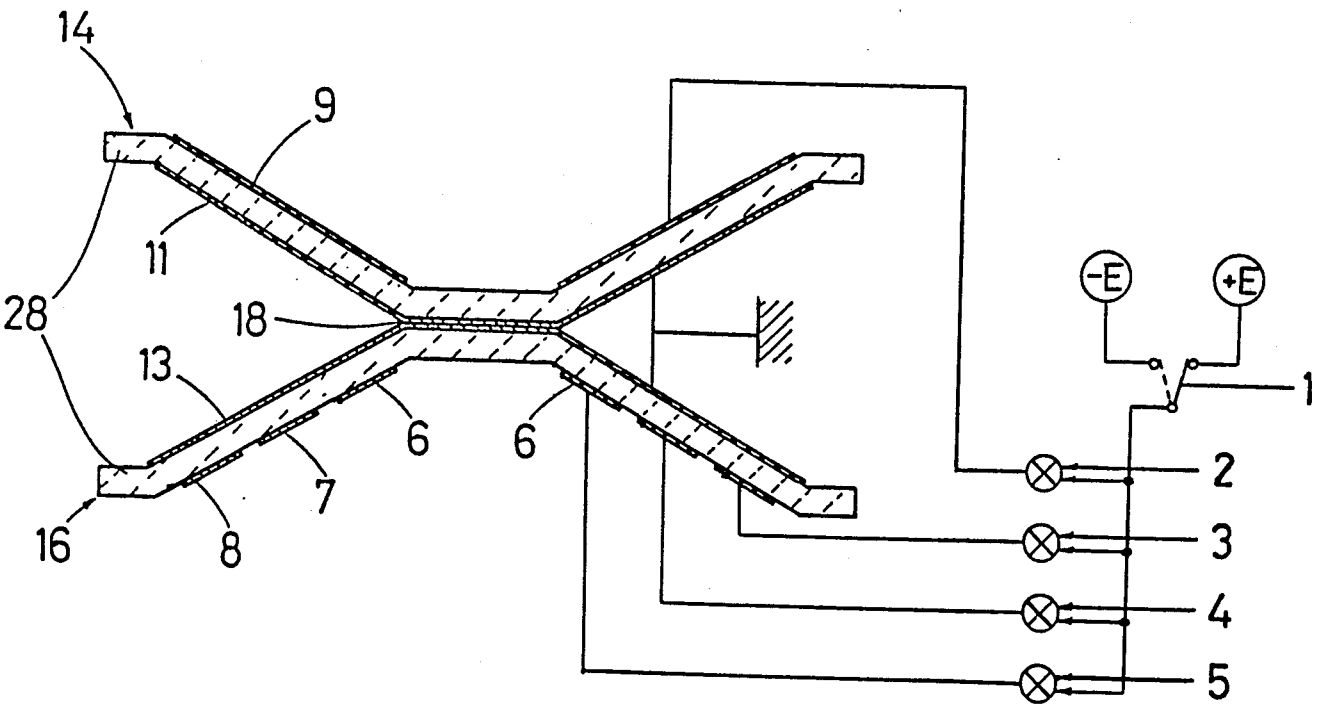
+E
-E
1
2
3
4
5
6
6
7
8
9
11
13
14
16
18
28

PIEZOELECTRIC FILM DEVICE FOR CONVERSION BETWEEN DIGITAL ELECTRIC SIGNALS AND ANALOG ACOUSTIC SIGNALS

FIELD OF THE INVENTION

This invention relates to acoustic transducers employing piezoelectric polymer films.

BACKGROUND OF THE INVENTION

Acoustic transducers using piezoelectric elements as an oscillator are known. For example, U.S. Pat. Nos. 3,832,580 and 3,792,204 describe transducers using a single piezoelectric film; an article by Tamura et al. presented in 1978 at the Acoustical Society Meeting in Honolulu describes a pair of piezoelectric films mounted over the upper and lower surfaces of a polyurethane-foam cushion; U.S. Pat. No. 3,832,580 describes the use of a plurality of piezoelectric elements suspended in various configurations, and U.S. Pat. No. 4,295,010, incorporated herein by reference, discloses improving the output of such piezoelectric transducers by using a plurality of piezolectric films that are mounted and spaced apart at their peripheries and physically connected near their centers by a dot of epoxy adhesive.

SUMMARY OF THE INVENTION

In general the invention features making a piezoelectric film transducer useful in directly converting a digital signal into an acoustic analog signal, by providing metallized film zones that have different areas and are electrically insulated from each other. By selectively exciting different zones or groups of zones with the digital signal, different amplitudes result in the acoustic signal, depending on the area of the particular zone or the combined area of the group of zones.

In preferred embodiments the shapes of the zones are concentric circular rings, spirals, crossed bands, or circular sectors; the transducer zones are excited by components of the digital signal; and bit components of the digital signal are carried by separate lines to the zones.

DESCRIPTION OF THE PREFERRED EMBODIMENT

The structure and operation of the presently preferred embodiment of the invention will now be described, after first briefly describing the drawing.

DRAWING

The FIGURE is a diagrammatic vertical sectional view of a transducer according to the invention.

STRUCTURE

The FIGURE shows a transducer made of two cone-shaped piezoelectric films 14, 16, which are connected at their centers by epoxy adhesive 18 and mounted at their peripheries upon a cylindrical support between rings (not shown). Films 14 and 16 are formed of layers 28 of polarized polyvinylidene fluoride, 9 microns thick and metallized on their surfaces by zones 6, 7, 8, 9, 11, 13 of gold, 200 A thick.

The films are polarized to yield strong piezoelectric strain coefficients in both directions (X and Y) of the film surface (commonly noted $d_{31}$ and $d_{32}$), so that the films deform symmetrically with resulting improved efficiency. The polarization vectors of films 14 and 16 are aligned normal to the surfaces of the films, and the films are mounted such that the two vectors are oriented in the same direction.

Film 16 is metallized on one side in three zones 6, 7, 8 shaped in concentric rings. (Zone 6 may be a full disk; i.e., the metallization may be extended to the central part of film 16 glued to film 14.) Film 14 is evenly metallized over virtually its entire surface. The area of zone 6 is about one-half of the area of zone 7, about one-quarter of the area of ring 8 and about one-eighth of the area of metallized surface 9 of film 14. The internal faces 11, 13 of films 14, 16 are evenly metallized and connected to a common ground.

The binary electrical signal to be converted to an analog acoustic signal is composed of 5 bits, each transmitted by parallel lines 1 to 5. Line 1 transmits the first (and largest) bit and line 5 the last (and smallest) bit of the 5-bit digital signal.

Line 1 also defines the sign of the digital signal and is connected to either a source of positive or negative voltage by a commutator. Line 2 is connected to zone 9, line 3 to zone 8, line 4 to zone 7, line 5 to zone 6. The areas of the zones excited by the lines transmitting different bits are graduated by powers of two, thus making it possible to decode a linearly coded signal by pulse code modulation (PCM).

OPERATION

In operation, the amplitude of the acoustic pulse generated by the excitation of a zone or a group of zones is proportional to the numerical size of the corresponding bit. Because the voltage applied to each metallized zone is constant, only the area of the excited zone influences the amplitude of the acoustic pulse. An analog acoustic filter allows the transformation into an analog sound signal.

OTHER EMBODIMENTS

Other embodiments of the invention are within the scope of the appended claims.

For example, the number of bits may be of 4, 5, 6 or more, according to the quality of the desired sound signal. Furthermore, it is possible to distribute the metallized surfaces in another way by using, for example, four piezoelectric films as described in U.S. Pat. No. 4,295,010. Also, the bit sign could be connected to a different film face.

What is claimed is:

1. An acoustic transducer comprising a plurality of metallized piezoelectric films operating as an oscillator, said films having their peripheries spaced apart and said films being each physically connected at its center region to at least one adjacent film, said films being electrically connected and their polarities selected in such a way that the films displace themselves in the same direction while electrically excited, at least one surface of said films having metallized zones insulated from each other and of different sized areas, so that zones can be selectively excited by a digital electrical signal, to directly convert the digital signal into an acoustic signal of pulses modulated in amplitude.

2. The transducer of claim 1 further comprising means to selectively excite said zones by bit components of said digital signal, the numerical value of said bits corresponding to the areas of said zones.

* * * * *